United States Patent [19]

Jeschke et al.

[11] Patent Number: 4,724,762

[45] Date of Patent: Feb. 16, 1988

[54] DEVICE FOR CLAMPING AND ALIGNING FLEXIBLE PRINTING PLATES ON A PLATE CYLINDER OF A ROTARY PRINTING MACHINE

[75] Inventors: Willi Jeschke, Heidelberg; Nikolaus Spiegel, Walldorf, both of Fed. Rep. of Germany

[73] Assignee: Heidelberger Druckmaschinen AG, Heidelberg, Fed. Rep. of Germany

[21] Appl. No.: 32,986

[22] Filed: Mar. 27, 1987

Related U.S. Application Data

[63] Continuation of Ser. No. 843,044, Mar. 24, 1986, abandoned.

[30] Foreign Application Priority Data

Mar. 22, 1985 [DE] Fed. Rep. of Germany ..... 3510440

[51] Int. Cl.[4] ..... B41F 27/00

[52] U.S. Cl. ..... 101/415.1

[58] Field of Search ..... 101/415.1, 378, 382 R, 101/383, 409, 410

[56] References Cited

U.S. PATENT DOCUMENTS

| | | | |
|---|---|---|---|
| 3,168,040 | 2/1965 | Norton | 101/415.1 |
| 3,557,695 | 1/1971 | Preuss | 101/415.1 |
| 3,858,512 | 1/1975 | Simeth | 101/415.1 |
| 3,884,147 | 5/1975 | Abendroth | 101/415.1 |
| 4,347,788 | 9/1982 | DuFour et al. | 101/415.1 |

*Primary Examiner*—J. Reed Fisher

*Attorney, Agent, or Firm*—Herbert L. Lerner; Laurence A. Greenberg

[57] ABSTRACT

A device for clamping and aligning a flexible printing plate on a plate cylinder of a printing machine, the device having two clamping rails disposed in a channel formed in and extending in a direction parallel to the axis of the plate cylinder for receiving therein a leading and trailing edge of a printing plate disposed on the periphery of the printing cylinder at which a beginning and an end of a sheet are printed, guides disposed in the channel wherein the clamping rails are guidably movable generally in peripheral direction of the plate and clamping bolts cooperatively engaging at least one of the clamping rails for clamping the printing plate in peripheral direction of the plate cylinder includes at least one clamping spring carried by one of the clamping rails for biasing the one clamping spring in a direction of action of the tensile force of the flexible printing plate so as to hold the printing plate under pretensioning in a predeterminable nominal position and free of play.

4 Claims, 5 Drawing Figures

DEVICE FOR CLAMPING AND ALIGNING FLEXIBLE PRINTING PLATES ON A PLATE CYLINDER OF A ROTARY PRINTING MACHINE

This application is a continuation of application Ser. No. 843,044, filed Mar. 24, 1986, now abandoned.

The invention relates to a device for clamping and aligning a flexible printing plate on a plate cylinder of a rotary printing machine and, more particularly, to such a device having two clamping rails disposed in a channel formed in and extending in a direction parallel to the axis of the plate cylinder for receiving therein a leading and a trailing edge of a printing plate disposed on the periphery of the printing cylinder at which a beginning and an end of a sheet are printed, guides disposed in the channel wherein the clamping rails are guidably movable generally in peripheral direction of the plate, and clamping bolts cooperatively engaging at least one of the clamping rails for clamping the printing plate in peripheral direction of the plate cylinder.

Such devices have become known heretofore, for example, from German Utility Pat. No. 84 35 189, and the purpose of such devices is to provide as exact a fit as possible of the printing plate which is clamped on the plate cylinder, in order to avoid the need for any subsequent correction. For this purpose, the clamping rail is alignable by means of adjusting bolts in a specific given position at which the beginning of a sheet is to be printed. In addition, means may also be provided on the printing plate per se which facilitate exact alignment of the printing plate. If this is not successful, a correction of the position of the mounted printing plate must then be performed which, as a rule, results in plastic deformation occurring therein due to wrap-around or looping contact friction. Such deformations, in turn, result in register errors which are extremely difficult to correct.

Further drawbacks have occurred with the prior art clamping devices in that the starting position is lost when the adjusting bolts are turned, the positioning accuracy is impaired by thread play which exists in the adjusting bolts, and the clamping rail tilts in its guides on the plate cylinder, i.e. the cylindrical body thereof, when the printing plate is inserted, even when compression springs are provided between the two clamping rails. All of this results in inaccuracies when aligning the printing plate before the latter is mounted and inevitably also in inexact clamping of the printing plate into position. If the printing plate which is now clamped in the front clamping rail moves into the machine under pressure between the plate and the rubber or blanket cylinder, the printing plate pulls on the front clamping rail which then tilts or tips in the direction of the tensile force of the printing plate backwards into the opposite contact position. As a result, the previously set nominal position of the printing plate relative to the cylinder is altered, thereby necessitating a correction of the position of the plate which is rather difficult to perform. Attempts which have been made to restrict or limit the play in the individual positioning or adjusting means have resulted in a jamming thereof in the guides in the direction of rotation, which is further intensified by soiling e.g. due to residues of ink and gumming.

Starting from this state of the art, it is an object of the invention to provide a plate clamping and aligning device with which it is possible to achieve highly accurate installation or assembly of printing plates in a relatively simple manner and which permits the printing plate which is clamped in position to be moved with such accuracy into the machine as to necessitate only minor corrections when it is tightly clamped onto the plate cylinder.

With the foregoing and other objects in view, there is provided, in accordance with the invention, a device for clamping and aligning a flexible printing plate on a plate cylinder of a printing machine, the device having two clamping rails disposed in a channel formed in and extending in a direction parallel to the axis of the plate cylinder for receiving therein a leading and trailing edge of a printing plate disposed on the periphery of the printing cylinder at which a beginning and an end of a sheet are printed, guides disposed in the channel wherein the clamping rails are guidably movable generally in peripheral direction of the plate and clamping bolts cooperatively engaging at least one of the clamping rails for clamping the printing plate in peripheral direction of the plate cylinder, comprising at least one clamping spring carried by one of the clamping rails for biasing the one clamping spring in a direction of action of the tensile force of the flexible printing plate so as to hold the printing plate under pretensioning in a predeterminable nominal position and free of play. The pretensioning attained using an additional or auxiliary force enables the play in the positioning or adjusting means to be eliminated, the additional force being selected to be so great that there is no change in the position of the clamping means on the one side when a new printing plate is inserted. In addition, the leaf springs are so constructed and applied that there are no bending moments acting on the clamping rail, but only tensile forces.

In accordance with another feature of the invention, there is provided a device including two adjusting bolts provided in addition to the clamping bolts for setting the nominal position of the one clamping rail, the adjusting bolts carrying respective lock units for fixing the position thereof. It is thus possible at any time to reclamp the printing plate without losing the set nominal position established by the adjusting bolts. This set nominal position of the clamping rail can be relocated or reset at any time by simply loosening the clamping bolts.

In accordance with a further feature of the invention, the clamping spring is constructed as a leaf spring and is located directly below the clamped printing plate and between the one clamping rail and the plate cylinder so as to prevent the one clamping rail from tilting when the printing plate is inserted, and means are included for bolting the leaf spring to the one clamping rail so that it is secured against torsion and is suspended in stops bolted to a wall of the channel formed in the plate cylinder.

The last-mentioned feature provides the benefit that the leaf springs which are arranged as close as possible to the printing plate do not impede the necessary clamping thereof.

In accordance with an additional feature of the invention, there is provided a device including a cup spring disposed between the one clamping rail and the respective adjusting bolts for eliminating thread play during the setting of the one clamping rail in the nominal position.

In accordance with a concomitant feature of the invention, the clamping bolts and the adjusting bolts are disposed at the same level in the one clamping rail and are formed with substantially spherical contact surfaces, and stops are included at respective walls of the channel formed in the plate cylinder, the clamping bolts and the adjusting bolts being braced against at least one of the stops.

It is thus possible, by accurately and exactly aligning and fixing the position of the clamping rail located at the leading edge of the printing plate, to introduce the clamped printing plate with such accuracy into the machine that any possibly necessary fine corrections of register will take place within the elasticity range of the printing plate.

Other features which are considered as characteristic for the invention are set forth in the appended claims.

Although the invention is illustrated and described herein as embodied in a device for clamping and aligning flexible printing plates on a plate cylinder of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
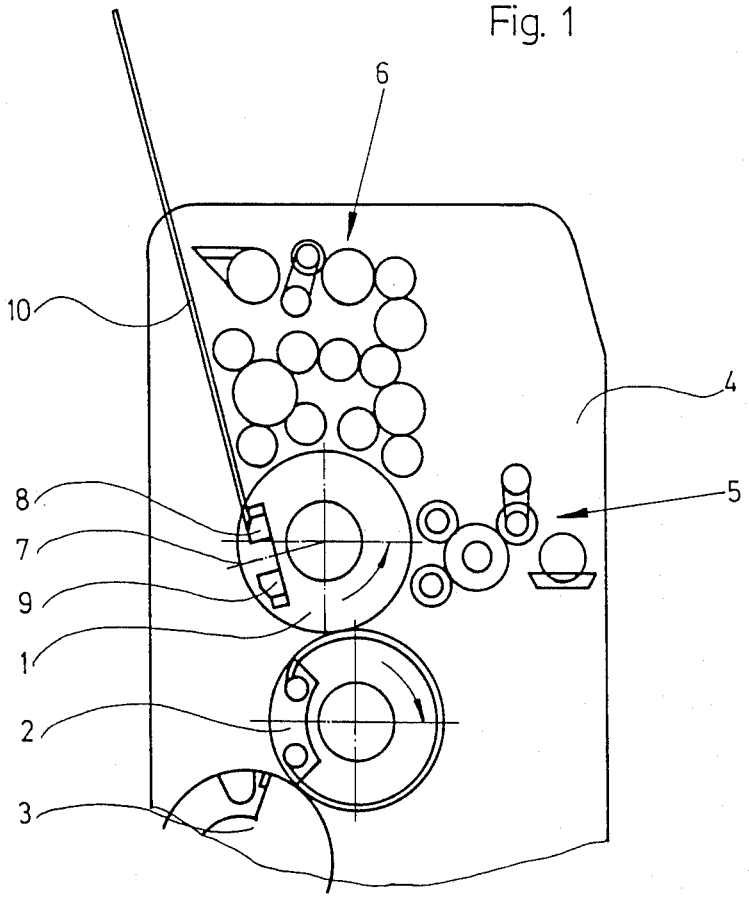
FIG. 1 is a fragmentary, diagrammatic view of a printing unit with a plate cylinder incorporating the clamping and aligning device according to the invention.

Referring now to the drawing and first, particularly, to FIG. 1 thereof, there is shown a printing unit conventionally including a plate cylinder 1, a rubber or blanket cylinder 2 and an impression cylinder 3, which are mounted at both ends thereof in side frames 4 of a rotary printing machines. A dampening unit 5 and an inking unit 6 are associated with the plate cylinder 1, and are likewise mounted at both ends thereof, respectively in the machine side frames 4.

The plate cylinder is formed with a channel 7 extending parallel to the axis thereof and having disposed therein a front clamping rail 8 and a rear clamping rail 9. To clamp and align a new printing plate 10, the printing plate is introduced somewhat in the position shown into the front clamping rail 8, thereby subjecting the front clamping rail 8 to a loading at least equivalent to the deadweight of the printing plate 10.

Figure 2:
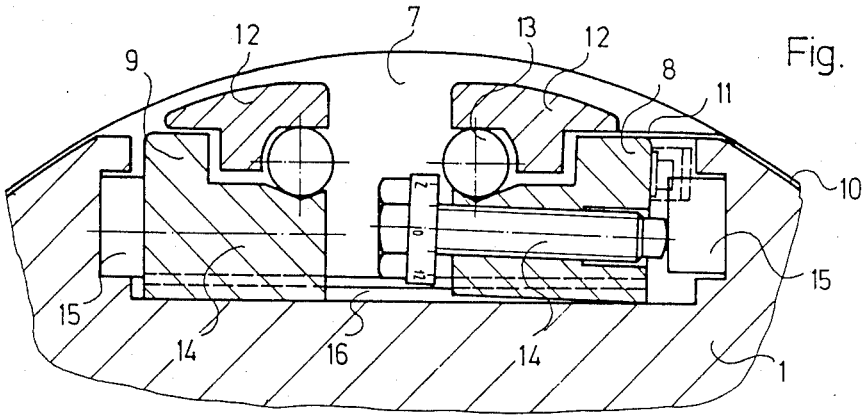
FIG. 2 is an enlarged, fragmentary cross-sectional view of FIG. 1 showing the device according to the invention with clamping bolts.
Figure 4:
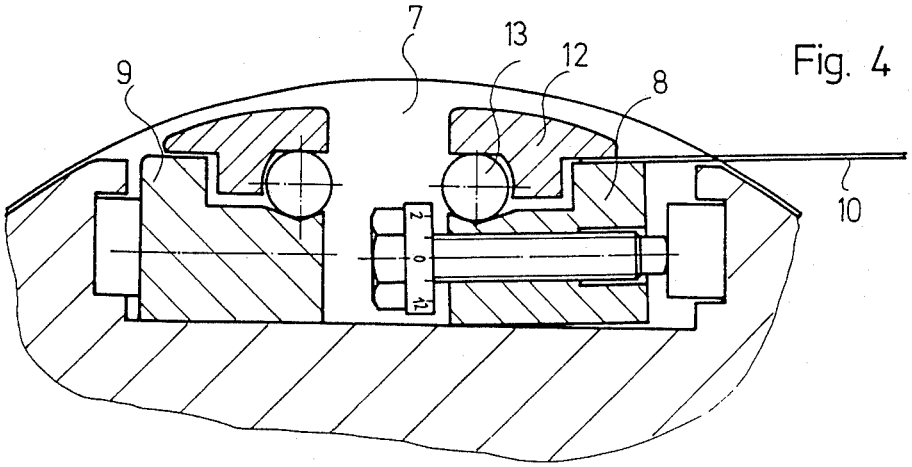
FIG. 4 is a view like that of FIG. 2 showing a clamping device according to the prior art wherein a clamping rail has become tilted when a new pressure plate is introduced.

FIG. 2 shows how the forward or leading end 11 of the printing plate 10 is clamped between the clamping rail 8 and a cover rail 12 with the aid of a clamping rod 13. Clamping bolts 14 are used to clamp the front or loading end 11 of the printing plate 10 and are braced against stops 15 on the channel wall of the cylinder 1. Such clamping bolts 14 are also provided for the rear clamping rail 9. Both clamping rails 8 and 9 extend shiftably or displaceably in guides 16 in the direction of rotation of the plate cylinder 1, the guides 16 being fastened to the bottom of the channel 6. The front or forward clamping rail 8 is illustrated in FIG. 2 with an exaggerated tilt or inclination relative to the bottom of the channel 7 in order to reveal the tensile forces acting upon the forward or leading end 11 of the printing plate 10 when the latter is introduced between the plate cylinder 1 and the rubber or blanket cylinder 2, the introduction being performed by turning the two cylinders 1 and 2 in the direction of the arrows associated therewith (see FIG. 1), these tensile forces resulting in the tilted or inclined appearance thereof due to the existing play. In contrast therewith, in FIG. 4, a printing plate 10 is merely inserted in accordance with FIG. 1 which, in the heretofore known constructions, resulted in the tilting movement being in the opposite direction, as is illustrated in FIG. 2 in an exaggerated manner.

Figure 3:
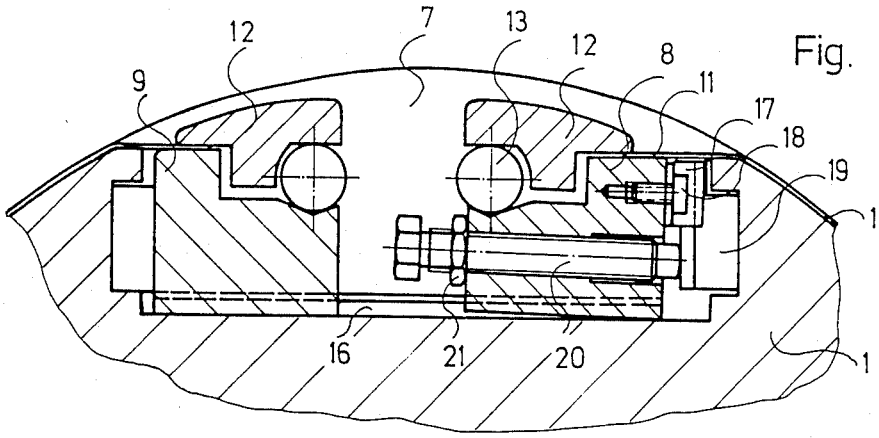
FIG. 3 is a view like that of FIG. 2 showing the device according to the invention with adjusting bolts or set screws.

A leaf or plate spring 17 is bolted, secured against torsion to the front clamping rail 8 by means of bolts 18, as shown in FIG. 3. The leaf spring 17 is located directly below the printing plate 10 and is suspended with pretensioning from the stops 19 bolted to the channel wall. The leaf spring exerts a tensile force on the forward or front clamping rail 8 so that it always remains in the tilted or inclined position shown in FIG. 3 even when a new printing plate is inserted, thus eliminating the play between the clamping rail 8 and the guide 16 and in the remaining clamping means.

Two adjusting bolts or setscrews 20 are provided over the length of the front clamping rail 8 which are fixed by means of lock nuts 21. The clamping rail 8 can be aligned by means of these adjusting bolts 20 in a specific starting position, making it possible always to start from this given nominal position, after a clamping operation. For this purpose, the adjusting bolts 20 are positioned at the same height as the clamping bolts 14 to ensure the same tilting location of the clamping rail 8. In addition, the contact faces of the adjusting and clamping bolts are crowned or spherical and thus supported on the stops 15 and 19, respectively. A non-illustrated cup spring is provided between the lock nut 21 and the clamping rail 8 to compensate for any play.

Figure 5:
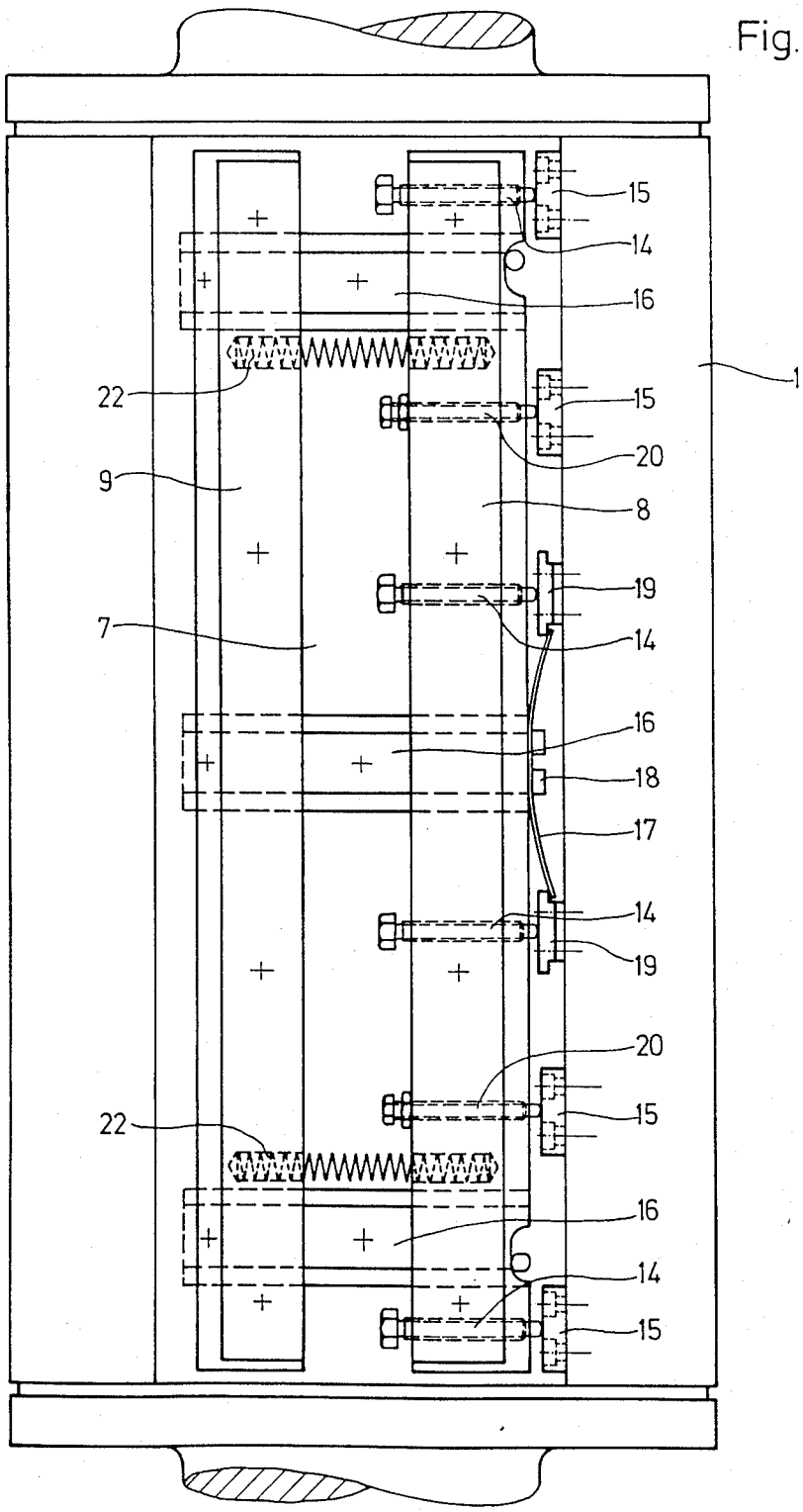
FIG. 5 is a diagrammatic plan or longitudinal view of a clamping device according to the invention.

As is shown in FIG. 5, compression springs 22 can be provided between the two clamping rails 8 and 9 to prevent any undesired shifting of the clamping rail 9 in the guides 16. These compression springs also assist the introduction of the rear or trailing end of the printing plate 10 between the clamping rail 9 and the cover rail 12.

The front or leading end 11 of the printing plate 10 can be inserted and aligned so exactly in the clamping rail 8 e.g. with the aid of fitted bolts and the like, that any fine correction of the fit at the end of the printing plate which may possibly be necessary will take place via the clamping rail 9 within the elasticity range of the printing plate. The stable starting position of the front clamping rail 8 required for this purpose is produced by means of the leaf springs 17. It is, of course, also possible to use other types of springs instead of leaf or plate springs.

We claim:

1. Device for clamping and aligning a flexible printing plate on a plate cylinder of a printing machine, the device having two clamping rails disposed in a channel formed in and defined by side walls extending in a direction parallel to the axis of the plate cylinder for receiving therein a leading and trailing edge of a printing plate disposed on the periphery of the printing cylinder at which a beginning and an end of a sheet are printed, each of the two clamping rails being disposed adjacent and substantially parallel to each of the channel walls, respectively, guides disposed in the channel wherein the clamping rails are guidably movable generally in pheripheral direction of the plate, and clamping bolts cooperatively engaging and extending transversely to at least one of the clamping rails for clamping the printing plate in peripheral direction of the plate cylinder, comprising at least one clamping spring carried by the one clamping rail for biasing the one clamping rail in a direction of action of the tensile force of the flexible printing plate so as to hold the printing plate under pretensioning in a predetermined nominal position and free of play, the one clamping rail being the rail at which the leading edge of the printing plate is clamped, and said one clamping spring being disposed between the one clamping rail and the respective channel wall adjacent thereto, and two adjusting bolts provided in addition to the clamping bolts for setting said nominal position of the one clamping rail, said adjusting bolts carrying respective lock nuts for fixing the position thereof.

2. Device according to claim 1 wherein said clamping spring is constructed as a leaf spring and is located directly below the clamped printing plate and between the one clamping rail and the plate cylinder so as to prevent the one clamping rail from tilting when the printing plate is inserted, and including means for bolting said leaf spring to the one clamping rail so that it is secured against torsion and is suspended in stops bolted to a wall of the channel formed in the plate cylinder.

3. Device according to claim 1 including a cup spring disposed between the one clamping rail and the respective adjusting bolts for eliminating thread play during the setting of the one clamping rail in said nominal position.

4. Device according to claim 1 wherein the clamping bolts and said adjusting bolts are disposed at the same level in the one clamping rail.

* * * * *